United States Patent [19]

Gardner et al.

[11] Patent Number: 4,543,936

[45] Date of Patent: Oct. 1, 1985

[54] SEQUENTIAL FUEL INJECTION SYNC PULSE GENERATOR

[75] Inventors: Robert F. Gardner, Flushing; Bruce D. Rohn, Clarkston, both of Mich.

[73] Assignee: General Motors Corporation, Detroit, Mich.

[21] Appl. No.: 650,861

[22] Filed: Sep. 17, 1984

[51] Int. Cl.[4] ..... F02B 5/00; F02B 3/00; F02M 39/00; F02P 5/04

[52] U.S. Cl. ..... 123/475; 123/490; 123/478

[58] Field of Search ..... 123/475, 490, 478

[56] References Cited

U.S. PATENT DOCUMENTS

| | | | |
|---|---|---|---|
| 3,855,973 | 12/1974 | Scofield | 123/490 |
| 3,961,604 | 6/1976 | Shimrong | 123/490 |
| 4,180,023 | 12/1979 | Kobayashi et al. | 123/475 |
| 4,284,052 | 8/1981 | Hanisko | 123/490 |
| 4,327,688 | 5/1982 | Lowther | 123/475 |
| 4,381,752 | 5/1983 | Hill | 123/475 |
| 4,417,201 | 11/1983 | Reddy | 123/490 |
| 4,452,210 | 6/1984 | Sasayama et al. | 123/490 |
| 4,463,728 | 8/1984 | Bagden | 123/475 |

*Primary Examiner*—Raymond A. Nelli
*Attorney, Agent, or Firm*—Mark A. Navarre

[57] ABSTRACT

Sync pulses are developed in timed relation to the occurrence of an ignition event in a specified cylinder of an engine employing a concurrent discharge ignition system. Ignition voltages for compression and exhaust cylinders are distinguished on the basis of the voltage magnitudes thereof.

4 Claims, 24 Drawing Figures

SEQUENTIAL FUEL INJECTION SYNC PULSE GENERATOR

This invention relates to sequential fuel injection controls for a multi-cylinder internal combustion engine having a concurrent discharge ignition system, and more particularly to a system for electronically generating synchronization (sync) pulses in relation to the occurrence of an ignition event in a specified engine cylinder.

In an internal combustion engine having a fuel system which sequentially injects the fuel for each cylinder in synchronism with engine rotation, a timing signal identifying a specified engine rotary position is required for control purposes. In one such system, the timing signal is obtained from a magnetic sensor mechanism located in proximity to the engine cam shaft and comprises periodically generated sync pulses which occur in relation to the top dead center position of a specified engine cylinder.

The copending U.S. patent application Ser. No. 479,487, filed Mar. 28, 1983, and assigned to the assignee of the present invention, discloses a system for electronically generating a timing signal and thereby eliminating the need for a camshaft sensor. In such system, the occurrence of an ignition event in a specified engine cylinder is detected by inductively sensing the ignition voltage at a point between a conventional ignition distributor and spark plug. The sharp rise in the ignition voltage on or about the occurrence of the ignition event is detected and used to develop the timing signal sync pulses. However, the application of such a technique to an engine having a concurrent discharge, or distributorless, ignition system is not straightforward. An ignition system of this type is shown in the Short et al. U.S. Pat. No. 3,202,146 issued on Aug. 24, 1965. In such systems, ignition voltages are concurrently generated for at least two of the ignition spark plugs and electrical discharges occur concurrently in the respective engine cylinders. One of the cylinders is in its compression stroke and the electrical discharge therein produces an ignition event; the other cylinder is in its exhaust stroke and the electrical discharge therein does not produce an ignition event. As a result, a sharp rise in the ignition voltage of a particular cylinder does not necessarily coincide with the occurrence of an ignition event therein.

The present invention is directed to a system for electronically generating an electrical sync pulse in relation to the occurrence of an ignition event in a specified engine cylinder where the engine ignition system is of the concurrent discharge type described above. The density of the gaseous mixture in a compression stroke cylinder is much greater than that in an exhaust stroke cylinder, and the ignition voltage required to produce an electrical discharge increases with increasing density. As a result the ignition voltage at or about the time the electrical discharges occur is significantly greater for the compression stroke cylinder than for the exhaust stroke cylinder. The system of this invention comprises electronic elements for sensing the ignition voltage magnitudes generated for both a specified engine cylinder and the other engine cylinder in which an electrical discharge is concurrently produced. The voltages are compared in timed relation to an ignition system control signal, and an output pulse is generated if the ignition voltage for the specified engine cylinder is greater than the ignition voltage for the other engine cylinder. A series of sync pulses are generated in response to such output signals and the sync pulses are applied to the fuel injection system to synchronize the operation thereof with engine rotation.

The present invention is described in reference to two embodiments. In the first embodiment the ignition voltages compared are derived directly from the ignition voltages as they occur. In the second embodiment the ignition voltages are first integrated over a specified time period and then compared.

IN THE DRAWINGS

Figure 1:
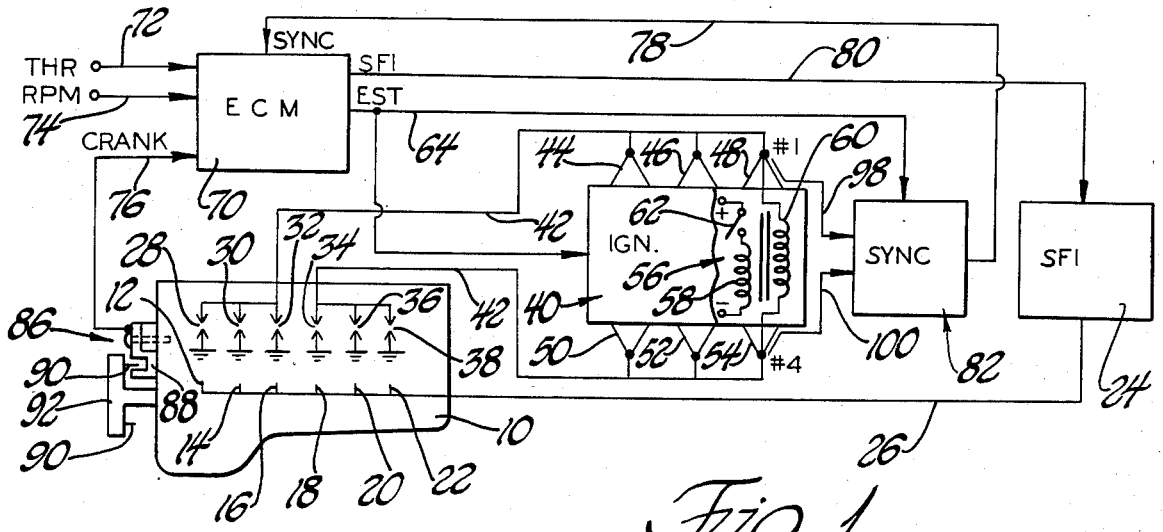
FIG. 1 is a block diagram depicting the engine and control system of this invention.

Referring now to the drawings, and more particularly to FIG. 1, the reference numeral 10 generally designates a six-cylinder internal combustion engine having fuel injectors 12, 14, 16, 18, 20 and 22, selectively energizable by a sequential fuel injection controller (SFI) 24 via the lines 26 for injecting fuel for the respective engine cylinders. The fuel is combined with air in a conventional manner to form a gaseous mixture in the respective engine cylinders and the spark plugs 28, 30, 32, 34, 36 and 38 are selectively controlled by an ignition unit (IGN) 40 via lines 42 to produce concurrent electrical discharges in two of the engine cylinders. The ignition unit 40 comprises three internal auto-transformers and six ignition towers 44, 46, 48, 50, 52 and 54 connected to the lines 42. A portion of the ignition unit 40 including the ignition towers 48 and 54 and the auto-transformer 56 is shown in more detail. Essentially, the auto-transformer 56 comprises a primary winding 58 and a secondary winding 60 inductively coupled thereto. The terminals of the primary winding 58 are connected to positive and negative voltage potentials as indicated and the ignition unit 40 includes control elements (not shown) for alternately opening and closing the switch 62 in accordance with the logic level of the signal on line 64 for alternately initiating and interrupting electrical current in the primary winding 58. The secondary winding 60 is connected at one terminal to the ignition tower 48 and at the other terminal to the ignition tower 54. Due to the inductive coupling between the primary and secondary windings 58 and 60, ignition voltages of opposite polarity are developed at the terminals of secondary winding 60 each time switch 62 is opened to interrupt the flow of current in the primary winding 58. The ignition voltages so developed are applied via two of the lines 42 to two of the spark plugs 28–38. When the ignition voltage thereby applied to the spark plug of a respective engine cylinder is sufficiently great to ionize the gaseous mixture therein, an electrical discharge occurs across the gap of the respective spark plug. It will be understood that the ignition unit 40 includes a second auto-transformer unit (not shown), such as the auto-transformer 56, for developing concurrent ignition voltages at the ignition towers 46 and 52, and a third auto-transformer unit (not shown) for developing concurrent ignition voltages at the ignition towers 44 and 50.

The development of the various ignition voltages is timed relative to the rotary position of engine 10 such that an electrical discharge occurs at a specified point in the compression stroke of each engine cylinder. Due to the manner in which the ignition voltages are generated, a second electrical discharge will concurrently occur in another engine cylinder which is in its exhaust stroke. The gaseous mixture in the compression stroke cylinder is combustible and the electrical discharge produced therein results in an ignition event. The gaseous mixture in the exhaust stroke cylinder is not combustible and the electrical discharge produced therein does not produce an ignition event. In a typical six-cylinder engine installation where the cylinder ignition event sequence is 1-2-3-4-5-6, electrical discharges are concurrently produced in the cylinders 1 and 4, in the cylinders 2 and 5, and in the cylinders 3 and 6. For the purpose of description, the ignition voltage generated at the ignition tower 48 will be referred to hereinafter as the #1 cylinder voltage, and the ignition voltage generated at the ignition tower 54 will be referred to as the #4 cylinder voltage.

An electronic control module (ECM) 70 is responsive to various input signals on lines 72, 74, 76 and 78, and is effective to produce an electronic spark timing (EST) output signal on line 64 for controlling the operation of ignition unit 40 and a sequential fuel injection (SFI) output signal on line 80 for controlling the operation of sequential fuel injection unit 24. The input signal on line 72 (THR) is indicative of the engine throttle or accelerator pedal position; the input signal on line 74 (RPM) is indicative of the engine speed; the input signal on line 76 (CRANK) is indicative of the engine crankshaft position; and the input signal on line 78 is a sync pulse timing signal generated by the sync pulse generator (SYNC) 82 of this invention. The throttle and speed signals on line 72 and 74 are obtained in a conventional manner and further description thereof is considered to be unnecessary. The crank signal on line 76 is obtained from a crankshaft sensor generally designated by the reference numeral 86, which includes a Hall Effect sensor 88 secured to the engine 10 and two or more magnetic elements 90 adapted to rotate with the engine flywheel 92. The Hall sensor 88 develops an electrical pulse on line 76 each time a magnetic element 90 passes in proximity thereto and the electronic control module (ECM) 70 receives such pulses as an indication of crankshaft displacement.

The electronic spark timing (EST) output signal on line 64 is developed in accordance with the throttle, engine speed and crankshaft position inputs on lines 72, 74 and 76, and comprises a series of digital pulses. At each rising edge of an EST signal pulse, the ignition unit 40 closes a switch, such as the switch 62, to energize the primary winding 58 of an auto-transformer 56. At the falling edge of the EST signal pulse, the switch 62 is opened to interrupt current in the primary winding 58 and to thereby generate opposite polarity ignition voltages at the terminals of a secondary winding 60 for producing electrical discharges in a pair of engine cylinders.

Figure 2:
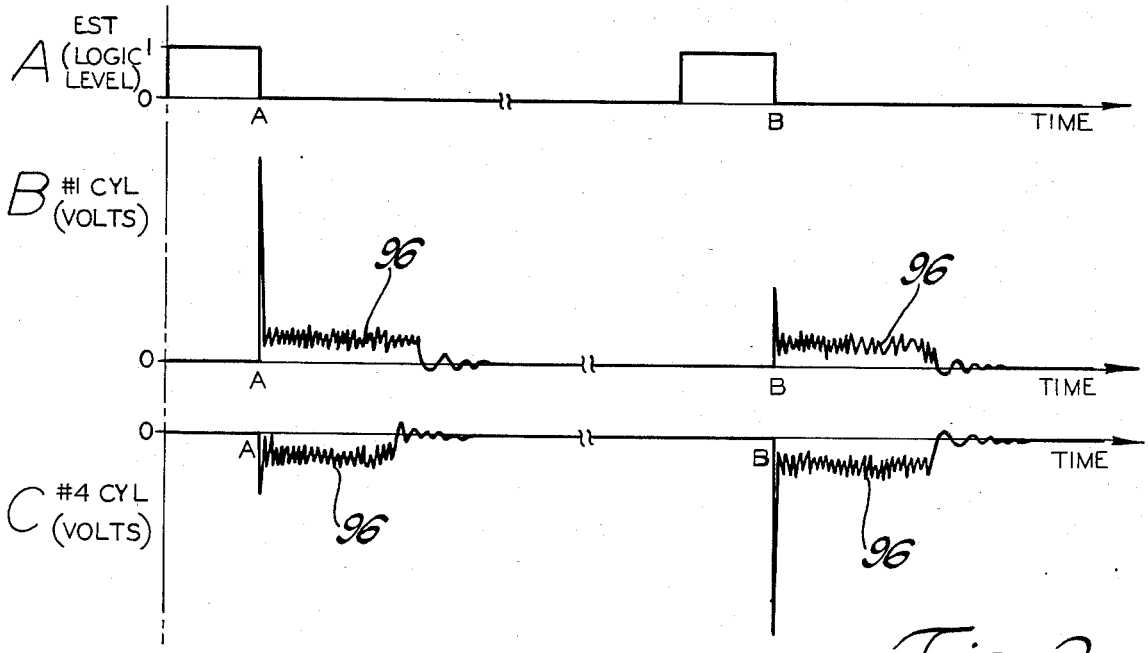
FIGS. 2A–2C are graphs depicting a control voltage which initiates the ignition sequence, and the ignition voltages for a pair of engine cylinders in which electrical discharges are concurrently generated.

Representative EST signals and ignition voltage signals are given in FIGS. 2A–2C. FIG. 2A depicts the EST signal on line 64, FIG. 2B depicts the #1 cylinder ignition voltage at ignition tower 48 and FIG. 2C depicts the #4 cylinder ignition voltage at ignition tower 54. The graphs are shown on a common time base discontinuous at the middle thereof so that two different EST pulses may be depicted. Times A and B correspond to the trailing edges of the EST pulses as seen in FIG. 2A. At such times, the current in the primary winding of the ignition unit auto-transformer is interrupted as described above and ignition voltages of opposite polarity are thereby developed at the ignition towers 48 and 54. At time A, the #1 engine cylinder is in its compression stroke and the #4 engine cylinder is in its exhaust stroke. At time B, the #1 engine cylinder is in its exhaust stroke and the #4 engine cylinder is in its compression stroke. Due to the increased density of the gaseous mixture in a compression stroke cylinder, the ignition voltage required to ionize the gas in a spark plug gap is relatively high for cylinder #1 at time A and for cylinder #4 at time B. Since the density of the gases in the exhaust stroke cylinder is relatively low, the peak ignition voltage for cylinder #4 at time A and for cylinder #1 at point B are relatively low. In both cases, however, the peak ignition voltage is followed by a period of electrical discharge as indicated by the reference numerals 96. At the termination of the electrical discharge, the ignition voltages return to a quiescent level after a period of resonant ringing. As will be described in detail herein, the present invention is directed to a method and apparatus for electronically detecting the difference in peak ignition voltages of the #1 and #4 engine cylinders to thereby identify an ignition event in the #1 cylinder (or any other specified engine cylinder) and to develop a sync pulse in relation thereto.

Figure 3:
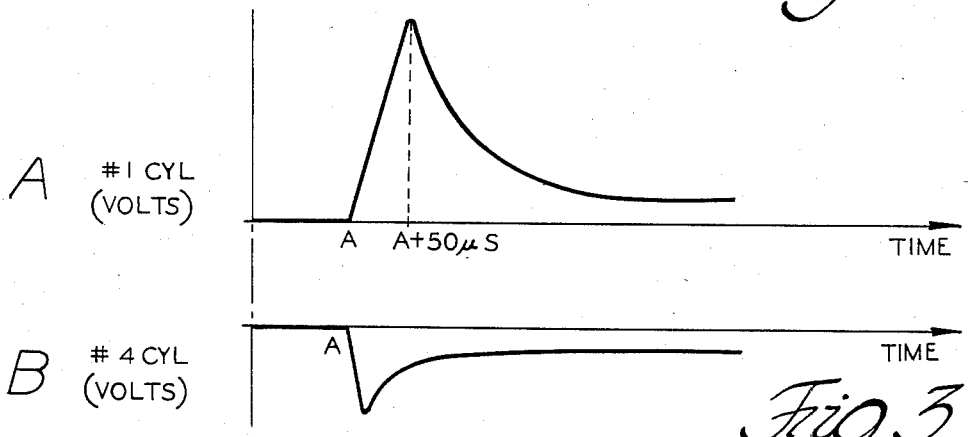
FIGS. 3A and 3B are graphs depicting the ignition voltages for a pair of engine cylinders in which electrical discharges are concurrently generated.

The ignition voltages for the cylinder #1 and cylinder #4 are shown on an expanded time base in the FIGS. 3A and 3B, respectively. In a typical engine application, it has been found that the peak ignition voltage in a compression cylinder occurs approximately 50 microseconds after the interruption of current in the primary winding of the respective auto-transformer at time A.

Referring once again to FIG. 1, the sequential fuel injection (SFI) output signal on line 80 is developed by the ECM 70 in accordance with a number of input signals including the sync pulse signal on line 78. As indicated earlier, the sync pulses are generated in synchronism with the engine rotation by sync pulse generator 82, and the ECM 70 utilizes such pulses to synchronize the fuel injection sequence with the engine rotary position. Inputs to the sync pulse generator 82 include the electronic spark timing (EST) signal on line 64 and the #1 and #4 ignition voltage signals on lines 98 and 100. The ignition voltage present at the ignition tower 48 of ignition unit 40 is capacitively coupled to the line 98 and the ignition voltage present at the ignition tower 54 is capacitively coupled to the line 100. The capacitive coupling in each case is effected by embedding the lines 98 and 100 in the insulating material of the ignition towers 48 and 54, respectively. The insulating material acts as a dielectric separating the lines 98 and 100 from the respective terminals of the secondary winding 60 of the auto-transformer 56. Thus, voltages such as those depicted in FIGS. 2B and 2C and in FIGS. 3A and 3B appear on the lines 98 and 100, respectively, each time the switch 62 is opened to interrupt current in primary winding 58 for generating electrical discharges in the #1 and #4 engine cylinders. As will be explained below, the sync pulse generator 82 uses such voltages in conjunction with the EST signal on line 64 to generate a timing signal on line 78 comprising a series of sync pulses which occur in timed relation with the #1 cylinder ignition events.

Figure 4:
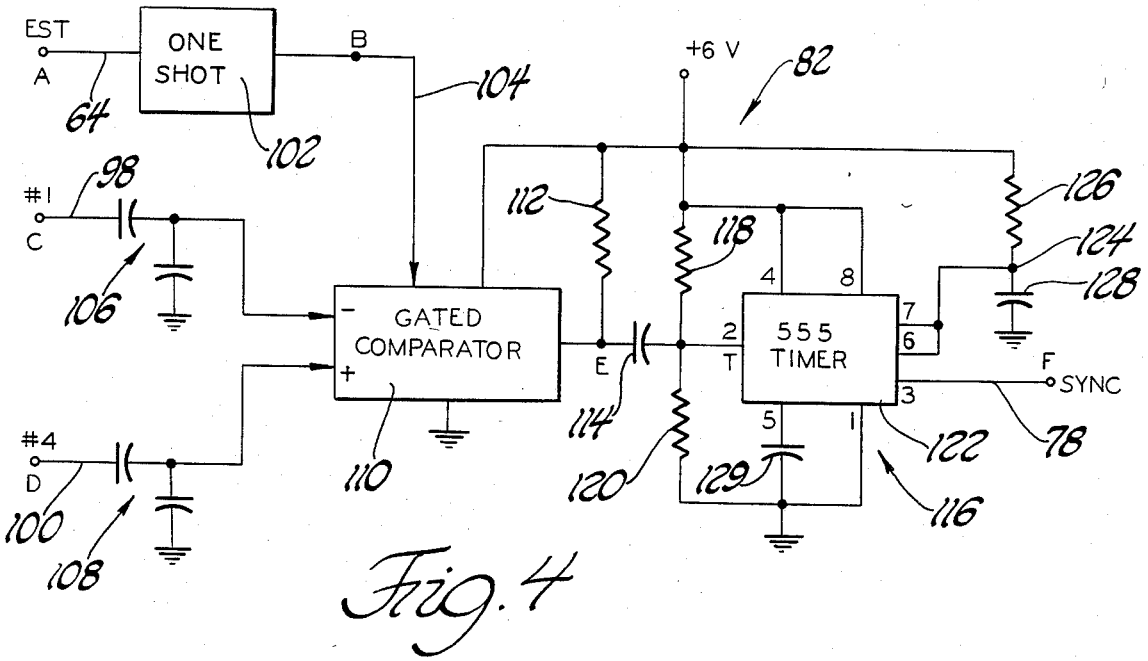
FIG. 4 is a circuit diagram of a system according to the first embodiment of this invention.

A circuit diagram of the sync pulse generator 82 according to a first embodiment of this invention is depicted in FIG. 4. The graphs shown in FIGS. 5A–5F, depict voltages present at the circuit junctions A–F of the circuit of FIG. 4. The reference numerals used in FIG. 4 correspond where applicable to those used in FIG. 1. Thus, the EST signal input is on line 64; the #1 engine cylinder voltage input is on line 98; the #4 engine cylinder voltage input is on line 100; and the sync pulse signal output is on line 78. In accordance with the convention set forth above, such signals are depicted in the graphs of FIGS. 5A, 5C, 5D and 5F, respectively. The EST signal on line 64 is applied as an input to one-shot 102, and in response to a negative going transition thereof, develops a pulse of predetermined duration on line 104. The #1 and #4 engine cylinder ignition voltages on lines 98 and 100 are applied through capacitive voltage dividers 106 and 108, respectively, to the inverting and non-inverting inputs of the gated comparator 110. The gated comparator 110 is effective when enabled by a logic 1 voltage potential on line 104 to compare the voltages applied to its inverting and noninverting inputs and to develop an output signal at the terminal E in accordance therewith. The pull-up resistor 112 normally maintains the voltage at the terminal E at a relatively high level and the comparator 110 is effective when enabled to lower such voltage substantially to ground potential if the voltage applied to its inverting input (#1 cylinder ignition voltage) is greater than the voltage applied to its noninverting input (#4 cylinder ignition voltage). The AC component of the voltage present at the terminal E is coupled via the capacitor 114 to the trigger input (T) of a monostable multivibrator, designated generally by the reference numeral 116. A voltage divider comprising the resistors 118 and 120 normally maintains the voltage at the trigger input (T) at a relatively high level but a negative going voltage excursion at the terminal E is effective to produce a corresponding negative going excursion at the trigger input (T) to thereby trigger the monostable multivibrator 116. Essentially, the monostable multivibrator 116 comprises an integrated circuit timer 122 such as the 555 Timer manufactured by Signetics Corporation. The timer 122 includes an internal switching device which normally holds the junction 124 between the resistor 126 and the capacitor 128 at or near ground potential. During such time, the output on line 78 is also at ground potential. When a negative going voltage is applied to the trigger input (T), the internal switching device releases the junction 124 and the capacitor 128 charges through the resistor 126. During such time, the output on line 78 is at a logic 1 voltage potential. When the voltage at terminal 124 exceeds a predetermined percentage of the supply voltage, a comparator internal to the timer 122 reapplies the switching device, bringing the junction 124 and the output signal on line 78 back to ground potential. The above process is repeated each time a negative going voltage is applied to the trigger input (T) of timer 122. The capacitor 129 functions to reduce the sensitivity of the timer to radiated electrical noise.

Figure 5:
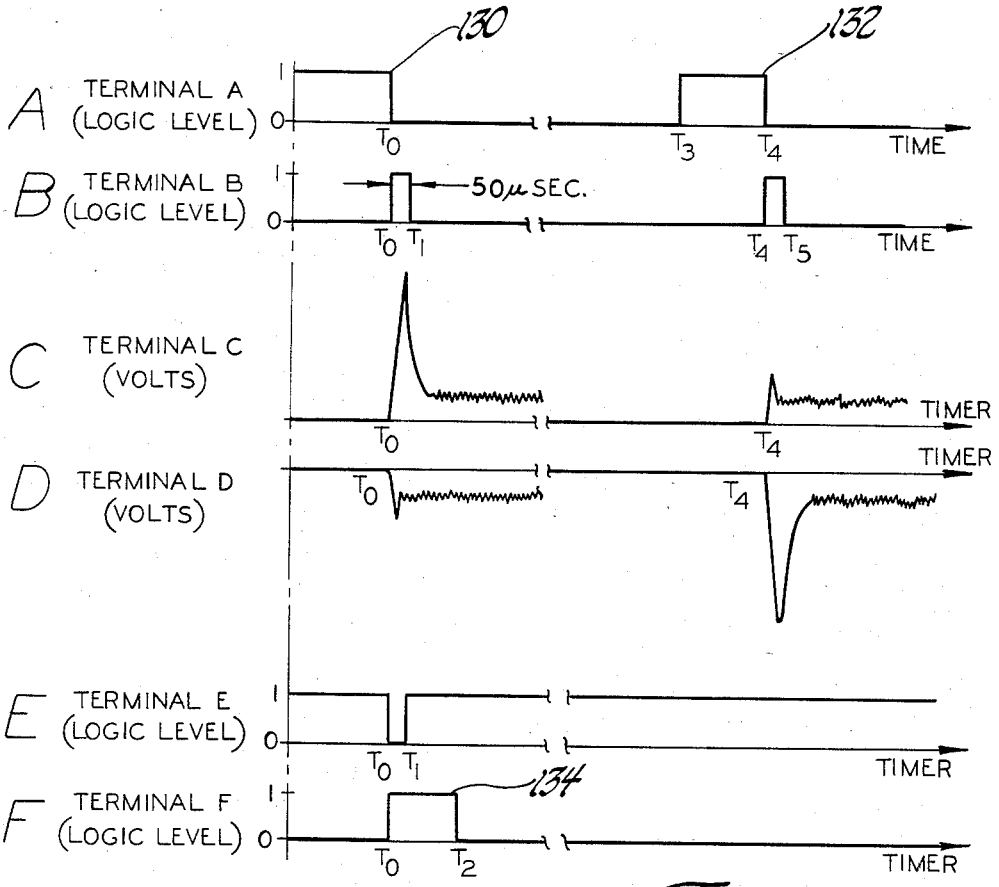
FIGS. 5A–5F are graphs depicting the operation of the system depicted in FIG. 4.

In view of the above, the operation of the circuit shown in FIG. 4 will be described in reference to the graphs of FIGS. 5A–5F. Each of the graphs are shown on a common time base discontinuous at the middle thereof so that two different EST pulses 130 and 132 may be depicted. The EST pulse 130 occurs while cylinder #1 is in its compression stroke and cylinder #4 is in its exhaust stroke. The EST pulse 132 occurs while cylinder #1 is in its exhaust stroke and cylinder #4 is in its compression stroke. Initially, the EST pulse 130 is at a logic 1 voltage potential resulting in the closure of the switch 62 and the energization of the primary winding 58 of ignition unit 40. At time $T_0$, the EST pulse 130 falls to a logic zero voltage potential and the switch 62 is opened to interrupt the current in primary winding 58. At such time, the one-shot 102 is triggered to produce a positive pulse of predetermined duration on line 104 as seen in FIG. 5B and ignition voltages for the #1 and #4 engine cylinders are generated and capacitively coupled to the lines 98 and 100 as seen in FIGS. 5C and 5D. As seen in FIG. 5B, the duration of the pulse developed by one-shot 102 is approximately 50 microseconds—the time typically required for the ignition voltage of a compression stroke cylinder to reach its peak value. In the interval between time $T_0$–$T_1$ when line 104 is at a logic 1 voltage potential, the gated comparator 110 is effective to compare the ignition voltages present on lines 98 and 100. Normally, the output of the gated comparator at terminal E is held at a logic 1 voltage potential, but comparator 110 is effective to reduce such voltage to substantially ground potential during such time interval if the #1 cylinder ignition voltage on line 98 is greater than the #4 engine cylinder ignition voltage on line 100. Since engine cylinder #1 is in its compression stroke, the magnitude of the ignition voltage required to produce an electrical discharge therein is significantly greater than that required for the engine cylinder #4, which is in its exhaust stroke, as seen in FIGS. 5C and 5D. As a result, the output of comparator 110 at terminal E is held at ground potential in the interval $T_0$–$T_1$ as seen in FIG. 5E. The negative going voltage transition at the terminal E produces a negative going voltage at the trigger input (T) of monostable multi-vibrator 116, thereby causing the output line 78 to rise to a logic 1 voltage potential as seen in FIG. 5F. When the capacitor 128 is charged through resistor 126 to a predetermined percentage of supply voltage at time $T_2$, the voltage on line 78 falls to a logic zero voltage potential as seen in FIG. 5F. The sync pulse 134 defined by the times $T_0$ and $T_2$ in FIG. 5 is thereby developed in timed relation to the occurrence of an ignition event in #1 engine cylinder and is used by the ECM 70 as a means for synchronizing the injection of fuel with the engine rotary position.

At the initiation of the EST pulse 132 at time $T_3$, the ignition switch 62 is closed to energize the primary winding 58 with current. At the termination of the EST pulse 132 at time $T_4$, the switch 62 is opened to interrupt current in the primary winding 58. At such time, the one-shot 102 is triggered to produce a positive pulse of predetermined duration on line 104 as seen in FIG. 5B and ignition voltages for the #1 and #4 engine cylinders are generated and capacitively coupled to the lines 98 and 100 as seen in FIGS. 5C and 5D, respectively. Since the #4 engine cylinder is in its compression stroke, the ignition voltage required to produce an electrical discharge therein is significantly higher than that required for the #1 engine cylinder which is in its exhaust stroke, as seen in FIGS. 5D and 5C. Thus, in the interval defined by the times $T_4$ and $T_5$, wherein the gated comparator 110 is enabled to compare the voltages on lines 98 and 100, the voltage at the comparator output terminal E remains at a logic 1 voltage potential. As a result, the monostable multi-vibrator 116 is not triggered and the voltage on output line 78 thereof is maintained at a logic zero voltage potential as seen in FIG. 5F.

In view of the above, it will be seen that the sync pulse generator depicted in FIG. 4 is effective to distinguish between an ignition voltage and consequent electrical discharge which produces an ignition event and an ignition voltage and consequent electrical discharge which does not produce an ignition event. For the two concurrent electrical discharges initiated by the EST pulses 130 and 132, only one sync pulse 134 is developed.

Figure 6:
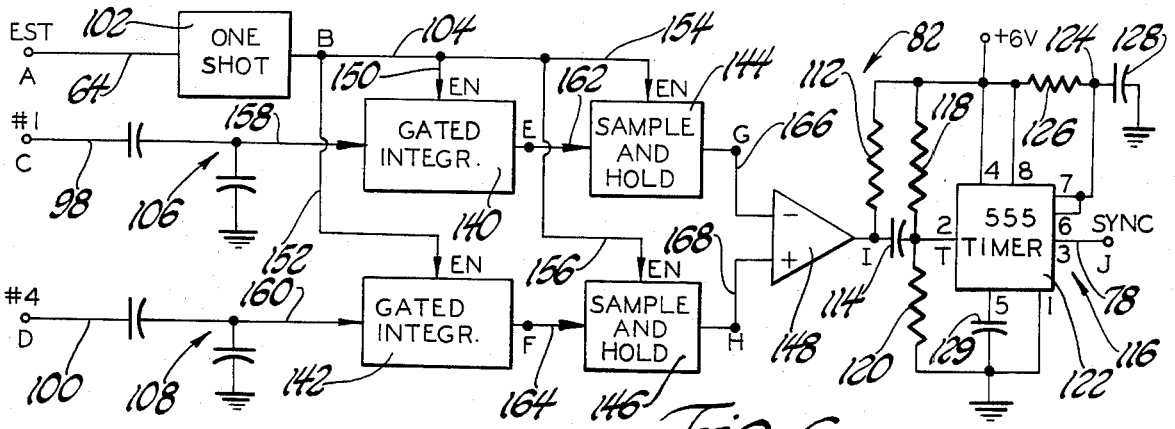
FIG. 6 is a circuit diagram of a system according to the second embodiment of this invention.

The sync pulse generator 82 according to a second embodiment of this invention is depicted in FIG. 6. Similarly to FIG. 4, various circuit junctions thereof are identified by the letters A–J and the graphs of FIGS. 7A–7J depict the voltages with respect to time which occur at such junctions. In addition, circuit elements in FIG. 6 which correspond to the circuit elements depicted in FIG. 4 have been assigned the same reference numerals. According to the second embodiment of this invention, the #1 and #4 engine cylinder voltages on lines 98 and 100 are each applied, after being suitably scaled by the capacitive dividers 106 and 108, to a gated integrator 140 or 142 and a sample and hold circuit 144 or 146 before application to a comparator 148. In the first embodiment, the comparator 110 is gated into operation by the output of one-shot 102—in the second embodiment, the integrators 140 and 142 and the sample and hold circuits 144 and 146 are gated into operation by the output pulse of one-shot 102. Thus, the output of one-shot 102 on line 104 is applied to the enable inputs (EN) of gated integrators 140 and 142 via lines 150 and 152, and to the enable inputs (EN) of sample and hold circuits 144 and 146 via lines 154 and 156. Both the gated integrators 140 and 142 and the sample and hold circuits 144 and 146 may be of conventional design and comprise well-known, over-the-counter devices. The gated integrators 140 and 142 are effective when a positive pulse is applied to the enable (EN) input thereof to integrate the respective #1 or #4 cylinder ignition voltage on line 158 or 160 with respect to time, and apply the result of such integration to the output terminals E or F, respectively. The sample and hold circuits 144 and 146 are each effective when a negative going voltage transition is applied to the enable (EN) input thereof to sample the voltage potential on line 162 or 164 and to hold such voltage at the output terminal G or H thereof. The output terminal G is applied via line 166 to the inverting input of comparator 148 and the output terminal H is applied via line 168 to the noninverting input of comparator 148. The output of comparator 148 at terminal I is applied through the AC coupling capacitor 114 to the trigger input (T) of the timer 122 which operates as described in reference to FIG. 4 to generate a sync pulse on line 78 of predetermined duration when a negative going voltage is applied to its trigger input.

Figure 7:
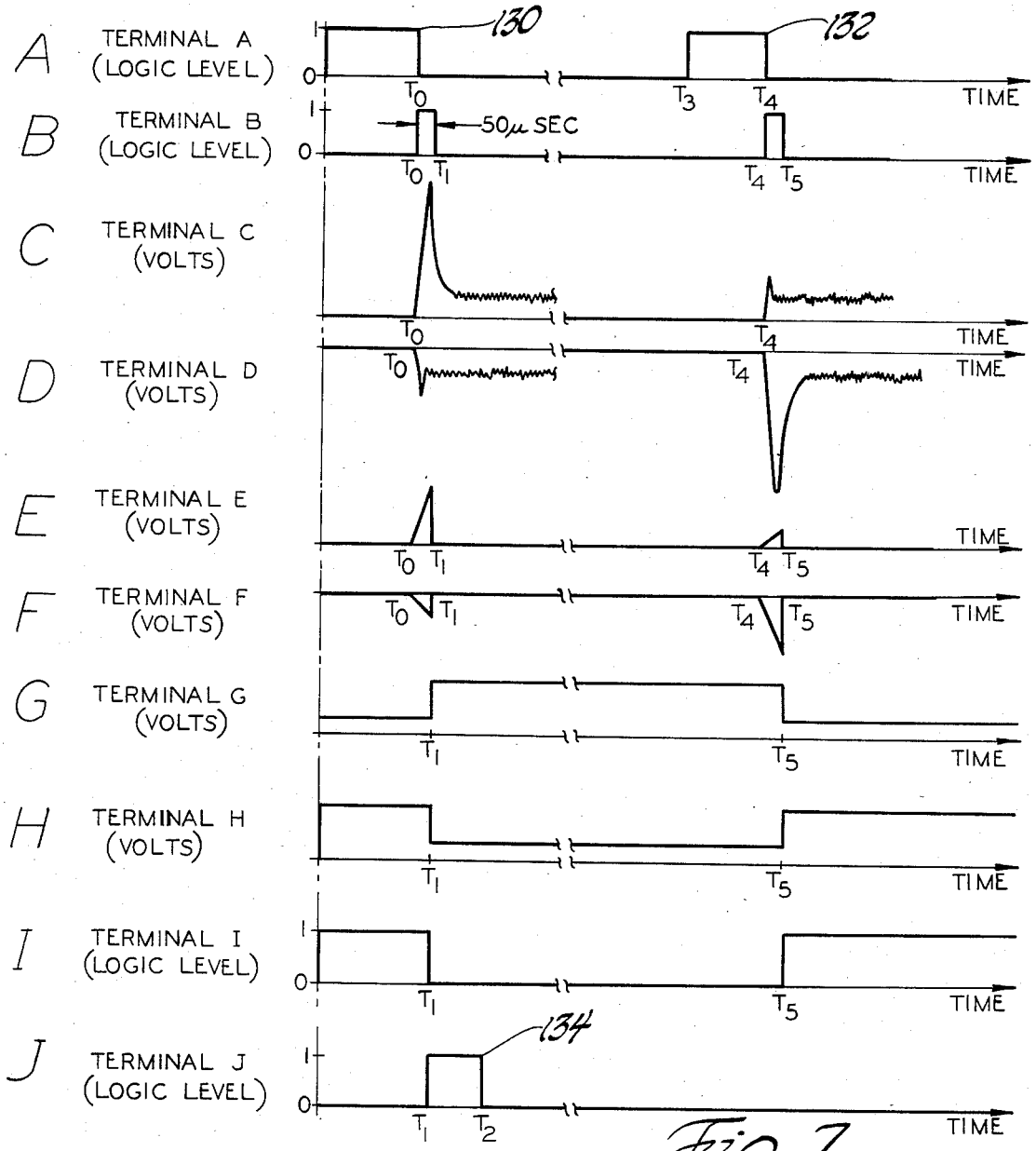
FIGS. 7A–7J are graphs depicting the operation of the system depicted in FIG. 6.

Referring to the graphs depicted in FIGS. 7A–7J, the operation of the circuit depicted in FIG. 6 will be described. As with FIG. 5, the graphs of FIGS. 7A–7J are depicted on a common time base which is discontinuous at its midsection in order to illustrate circuit operation for two different EST pulses 130 and 132. Also, as with FIG. 5, the EST pulse 130 occurs while the #1 cylinder is in its compression stroke and the #4 cylinder is in its exhaust stroke. The EST pulse 132 occurs while the #1 cylinder is in its exhaust stroke and the #4 cylinder is in its compression stroke. Initially, the EST pulse 130 is at a logic 1 voltage potential causing the switch 62 of ignition unit 40 to be closed, thereby energizing the primary winding 58 of auto-transformer 56 with current. At time $T_0$ the EST pulse 130 falls to a logic 0 voltage potential. As a result, the one-shot 102 is triggered into operation to produce a positive pulse of predetermined duration on line 104 as seen in FIG. 7B and ignition voltages for the #1 and #4 engine cylinders are generated at the terminals of the secondary winding 60 as seen in FIGS. 7C and 7D, respectively. The gated integrators 140 and 142 are also gated into operation during the interval of the pulse generated by one-shot 102 and hence integrate the respective ignition voltages with respect to time over such interval. The gated integrator 140 integrates the #1 engine cylinder ignition voltage and the output of such integrator at terminal E is depicted in FIG. 7E. The gated integrator 142 integrates the #4 engine cylinder ignition voltage and the output of such integrator at terminal F is depicted in FIG. 7F. Since the #1 engine cylinder is in its compression stroke and the #4 engine cylinder is in its exhaust stroke, the ignition voltage magnitude on line 98 is greater than that on line 100. This difference in magnitude is detected according to the second embodiment of this invention by detecting the difference in the final value of the gated integrators 140 and 142 at time $T_1$ when the output pulse of one-shot 102 terminates. At time $T_1$ the sample-and-hold circuits 144 and 146 are enabled by the negative going voltage transition on line 154 and 156 to sample and hold the integrator values and the integrators are reset to zero. Thus, the sample-and-hold circuit 144 holds the final value of integrator 140 at the output terminal G and the sample-and-hold circuit 146 holds the final value of the gated integrator 142 at the output terminal H, the voltage at terminal G being depicted in FIG. 7G and the voltage at terminal H being depicted in FIG. 7H. Since at time $T_1$ the voltage at terminal G is suddenly greater than the voltage at terminal H, the comparator 148 changes to its low impedance output state and its output voltage at terminal I falls to a logic zero voltage potential as seen in FIG. 7I. In response thereto, the output of timer 122 on line 78 rises to a logic 1 voltage potential as seen in FIG. 7J and the capacitor 128 begins charging through the resistor 126. Since the voltages applied to the comparator inputs are held by sample and hold circuits 144 and 146, the output of comparator 148 at junction I remains at a logic zero voltage potential as seen in FIG. 7I. When the capacitor 128 is charged to a predetermined percentage of the supply voltage at time $T_2$, the capacitor 128 is discharged and the output of timer 122 on line 78 falls to a logic zero voltage potential as seen in FIG. 7J.

At a later point in time, when the #1 engine cylinder is in its exhaust stroke and the #4 engine cylinder is in its compression stroke, the EST pulse 132 occurs. At the initiation thereof at time $T_3$, the switch 62 of ignition unit 40 closes to energize the primary winding 58 of auto-transformer 56 with current. At time $T_4$, the EST pulse 132 terminates, and ignition unit 40 opens the switch 62 to interrupt current in the primary winding 58. The trailing edge of the EST pulse 132 causes the one-shot 102 to produce a positive pulse of predetermined duration on line 104 as seen in FIG. 7B, and produces ignition voltages for the #1 and #4 engine cylinders as seen in FIGS. 7C and 7D. However, the #1 cylinder ignition voltage in FIG. 7C is relatively small because that cylinder is in its exhaust stroke, and the magnitude of the #4 engine cylinder ignition voltage is relatively high since such cylinder is in its compression stroke. As a result, the final value of the integrator 142 (terminal F) is greater than that of the integrator 140 (terminal E) at time $T_5$ when the output of one-shot 102 at terminal B falls to a logic zero voltage potential. Thus, at time $T_5$ when the sample and hold circuits 144 and 146 are enabled to store such final values, the comparator 148 changes state and permits its output voltage at terminal I to be pulled up to logic 1 voltage potential as seen in FIG. 7I. Such voltage transition is positive in nature and the monostable multi-vibrator 116 does not produce a sync pulse in response thereto.

As with the first embodiment, the second embodiment of this invention is effective to distinguish between concurrently generated ignition voltages in compression and exhaust stroke engine cylinders and to generate a sync pulse 134 only when the ignition voltages produce an ignition event in a specified #1 engine cylinder. The rising edge of the sync pulses according to the second embodiment follow the interruption of current in the primary winding 58 by an interval corresponding to the duration of the one-shot 102 since the final value of the gated integrators 140 and 142 is used to distinguish between the ignition voltages. Since typical fuel injection specifications require only that the sync pulse be generated prior to an ignition event in the next fired engine cylinder, some leeway in the timing of the sync pulse is permitted. The first embodiment circuit of FIG. 4 has been found to perform adequately, but the second embodiment of FIG. 6 is preferred if the ignition voltages are obtained in an electrically noisy environment due to the ability of the integrators to ignore or cancel out such noise.

In view of the above, it will be understood that while this invention has been described in reference to two illustrated embodiments, various modifications thereto will occur to those skilled in the art and that pulse sync generators employing such modifications may fall within the scope of this invention which is defined by the appended claims.

The embodiments of the invention in which an exclusive property or privilege is claimed are defined as follows:

1. For an internal combustion engine including at least two cylinders in which gaseous mixtures alternately undergo compression and expansion before and after the ignition thereof, and an ignition system of the type including primary and secondary transformer windings, the secondary winding of which is connected at one end thereof to a sparking device in one of said cylinders and at the other end thereof to a sparking device in the other of said cylinders such that interruption of current in the primary winding generates ignition voltages of opposite polarity at the ends of said secondary winding for triggering substantially concurrent electrical discharges at said sparking devices for producing an ignition event in the compression cylinder, a system for generating electrical sync signals in relation to the occurrence of such ignition event in a specified one of said cylinders, comprising:

means for sensing the ignition voltage magnitudes generated for each of said cylinders, such magnitudes at the point of electrical discharge being determined as a function of the density of the gaseous mixtures therein, the compression cylinder voltage magnitude thereby being relatively large as compared to the expansion cylinder voltage magnitude;

comparator means effective a predetermined time after the interruption of current in said primary winding for comparing the sensed ignition voltage magnitudes of said two cylinders and for generating an output signal if the sensed voltage magnitude of the specified cylinder is larger than that of the other of said cylinders, whereby such output signals are repetitively generated in coincidence with the generation of a compression cylinder ignition voltage for said specified cylinder; and means for generating an electrical sync signal in timed relation to the generation of an output signal by said comparator means, whereby the sync signals are repetitively generated in timed relation to the occurrence of ignition events in said specified cylinder.

2. A system as set forth in claim 1 wherein the predetermined time of said comparator means corresponds to the time nominally required for the compression ignition voltage to reach its peak magnitude once the primary winding current has been interrupted.

3. A system as set forth in claim 1, wherein said comparator means includes:

means for integrating the sensed ignition voltage magnitudes over a predetermined period of time beginning at the interruption of current in said primary winding; and means effective at the end of said predetermined period of time for comparing such integrated voltages and for generating an output signal if the integrated voltage associated with said specified cylinder is larger than the integrated voltage associated with the other of said cylinders, whereby such output signals are repetitively generated in coincidence with the generation of a compression ignition voltage for said specified cylinder.

4. For an internal combustion engine including a distributorless ignition system for igniting multiple cylinders sequentially in a predetermined firing order and a fuel injection system for delivering fuel to the multiple cylinders sequentially in the firing order in advance of ignition based upon a sync signal generated in timed relation to the occurence of ignition in a particular cylinder in the firing order, the ignition system being of the type including primary and secondary transformer windings where the secondary winding is connected at one end to an igniter in the particular cylinder and at the other end to an igniter in another cylinder where the two cylinders are so spaced in the firing order that they alternately undergo compression and expansion in opposite phase and such that interruption of current in the primary winding generates ignition voltages of opposite polarity at the respective ends of the secondary winding for causing the igniters to develop substantially concurrent electrical discharges in the cylinders so as to produce fuel ignition in the cylinder undergoing compression, the method comprising:

sensing the respective ignition voltages developed as to each cylinder, the magnitude of each such voltage being determined as a function of the density of the gaseous mixture within the cylinder at the onset of the electrical discharge in the cylinder such that the voltage magnitude developed as to the cylinder undergoing compression is larger than the voltage magnitude developed as to the cylinder undergoing expansion;

associating the interruption of current in the primary winding with the occurrence of ignition in the particular cylinder when the ensuing sensed voltage magnitude developed as to the particular cylinder is larger than the ensuing sensed voltage magnitude developed as to the other cylinder; and generating the sync signal in timed relation to the associated interruption of current in the primary winding thereby eliminating the need for a separate sensor to develop the sync signal.

* * * * *